US005334265A

United States Patent [19]

Shalin et al.

[11] Patent Number: 5,334,265

[45] Date of Patent: Aug. 2, 1994

[54] MAGNETIC METAL

[75] Inventors: Rady E. Shalin; Alexandr N. Savich; Evgeny B. Kachanov, all of Moscow; Alexandr F. Petrakov, Moskovskaya oblast; Vadim P. Piskorsky, Moscow; Alexandr I. Vevjurko, Moscow; Vladislav K. Orlov, Moscow; Eduard N. Shingarev, Moscow; Sergei I. Ivanov, Moscow; Jury V. Khaskin, Moscow; Alexandr S. Buinovsky; Vladimir M. Kondakov, both of Tomsk, all of U.S.S.R.

[73] Assignee: Aura System Inc., El Segundo, Calif.

[21] Appl. No.: 13,766

[22] Filed: Feb. 4, 1993

[51] Int. Cl.[5] ..... H01F 1/053

[52] U.S. Cl. ..... 148/302; 420/83; 420/121

[58] Field of Search ..... 148/301, 302; 420/83, 420/121

[56] References Cited

U.S. PATENT DOCUMENTS 4,789,521 12/1988 Narasimhan et al. ..... 420/83

4,929,275 5/1990 Bogatin ..... 75/246

*Primary Examiner*—John P. Sheehan

*Attorney, Agent, or Firm*—Ladas & Parry

[57] ABSTRACT

The magnetic material disclosed in a preferred embodiment of the invention contains the following relative proportion of components, at. %:

| | |
|---|---|
| at least one of the rare earth elements selected from the group consisting of Neodymium and Praseodymium | 12.0–17.0; |
| at least one of the rare earth elements selected from the group consisting of Dysprosium and Terbium | 0.1–5.0 |
| at least one of the elements selected from the group consisting of Aluminum, Niobium, and Chrome | 0.5–4.0; |
| at least one of the elements selected from the group consisting of Titanium, Hafnium, Zirconium, Vanadium and Titanium | 0.1–1.5; |
| Cobalt | 2.0–6.0 |
| Boron | 6.5–8.5 |
| Uranium | 0.05–1.5 |
| Iron | remainder |

7 Claims, 4 Drawing Sheets

MAGNETIC METAL

FIELD OF THE INVENTION

The present invention pertains to special materials possessing special physical characteristics and qualities, and, more specifically, pertains to magnetic materials.

DESCRIPTION OF THE RELATED ART

The magnetic materials of the Fe-B-R and Fe-B-Co-R systems, possessing a high level of magnetic energy (BH/2) max are presently well known and widely utilized in electrical motors, generators, magnetic clutches, etc. The above materials are also utilized in the various types of home technology, in audio and video components, in computer peripherals, food processors, coffee grinders, hair dryers, vacuum cleaners, refrigerators, etc.

It should be noted, however, that the relatively low values of the coercive force iHc characteristic of the listed materials restrict to some extent the sphere of the their applicability. It is well known that with an increase in temperature of a permanent magnet, its coercive force iHc will decrease and the permanent magnet maybe completely demagnetized due to its exposure to the increased temperature. If its coercive force iHc is relatively high at room temperature, such demagnetizing influence by the means of temperature will be insignificant.

Additionally, an increase in the value of the coercive force iHc of the material, as pertains to the permanent magnets, allows a decrease in the thickness of the permanent magnet while preserving the required technological characteristics of the product. Therefore, in the case of permanent magnets, an increase in iHc of the materials and the decrease in the energy expenditures required for the production of 1 kg of magnets, constitutes the current challenge of the time.

Specific energy expenditures incurred at the time of production of permanent magnets composed of known materials from systems Fe-B-R and Fe-B-Co-R are relatively high.

One known magnetic material is of the Fe-B-R system (Patent EP N 0134305 Aj). Within the known material R constitutes the sum total of $R_1$ and $R_2$, while $R_1$ is, at least, one of the rare earth elements selected from the group of: Neodymium (Nd), Praseodymium (Pr), while $R_2$ is, at least, one of the rare earth elements selected from the group of: Dysprosium (Dy), Terbium (Tb), Gadolinium (Gd), Holmium (Ho), Erbium (Er), Thulium (Tm), and Ytterbium (Yb). The known material contains an admixture of M, which is at least, one of the elements selected frown the group of Chrome (Cr), Tantalum (Ta), Niobium (Nb), Aluminum (Al), Vanadium (V), Tungsten (W), and Molybdenum (Mo).

The above elements contained in the known material are maintained in the following composition (at. %): 0.05-5% $R_1$, 12.5-20% R, 4-20% B and the remaining iron (Fe) with admixtures of M, not in excess of 9%.

It is well known that the characteristic traits of the permanent magnet material of the Fe-B-R system are determined by the quantity and size of granules, by the specific magnetization and by the coercive force of the core phase $(R)_2Fe_{14}B$, as well as by the quantity, structure, and composition of phases isolating the granules of the core phase $(R)_2Fe_{14}B$.

In order to obtain the peak traits of the magnetic material, as, for example, (BH) max, operation temperature (Tmo), it is required that the core phase $(R)_2Fe_{14}B$ be present in the material in a quantity approaching 100%, that it has the optimal granule size, and the peak possible values of specific magnetization and coercive force, while tile phases isolating the core phase granules $(R)_2Fe_{14}B$ from each other have to appear in the minimal quantity and be located along the perimeter of the main core granules and be nonmagnetic.

Presence of such rare earth elements in the known material, as Dysprosium (Dy), Terbium (Tb), Gadolinium (Gd), Holmium (Ho), etc. increases to a greater or lesser extent the range of anisotrophy $H_A$ within the core phase $(NdR)_2Fe_{14}B$ of the magnetic material which in turn determines the increase of the coercive force iHc. However, the mutual influence and interaction between the rare earth element ions and those of iron causes the antiferromagnetic orientation of their magnetic aspects which, in turn, causes a significant decrease of specific magnetization and thus of residual induction of Br and (BH)max. In order to increase the residual induction of Br additional, magnetically neutral elements of Cr, Al, Nb, etc. are introduced into the magnetic material, while the contents of Dysprosium (Dy) and Terbium (Tb) in the material, which increase the magnet value, are being simultaneously decreased. The primary mechanism by which the additional, above-named elements affect the coercive force is by the means of formation of slightly magnetic phases enriched by Neodymium and which isolate the granules of the core phase from each other. Some of these elements, for example, Al, increase the wetability of the core phase $Nd_2Fe_{14}B$ by the fluid phase, which, in turn, accelerates the caking process, while producing the magnetic material. Since the size of the core phase granules of the magnetic material is not uniform and actually fluctuates within a range of 0.3-80 μm, the material has a relatively low coercive force iHc.

Based on the factors presented above, the magnetic traits of this material are relatively low. Specifically:

the coercive force iHc=5-20 kOe power generation (BH)max=5-38, 4 MGOe, residual induction Br=5-12 KG.

It should be noted that the low values of the coercive force are associated with the high values (BH)max and, vice-versa, the high values of (Bit)max are associated with the lower values of iHc. In the case of optimal inter-relationships of the components within the known magnetic material, the coercive force iHc will be at least 10 kOe, (BH)max will be at least 20 MGOe, and the residual induction Br will be at least 9 KG. At temperatures exceeding 80°-100° C. the known material exhibits an abrupt decrease of its magnetic characteristics since it has a low Curie temperature Tc=310° C. This trait limits its applicability within electrical mechanisms of high specific capacity. The known material also exhibits relatively high energy expenditure at the time of its manufacture due to the high stability of the ingot and the caking temperature.

Another known magnetic material with a higher Curie temperature is the one of the type Fe-B-Co-R (patent EP N 0106948 $B_1$). Within the known material, R constitutes the sum total of $R_1$ and $R_2$, while $R_1$ is, at least, one of the rare earth elements selected from the group of Neodymium (Nd), Praseodymium (Pr) while $R_2$ is at least one of the heavy rare earth elements. The known material also incorporates the admixture of M, which constitutes the sum total of $M_1$ and $M_2$, while $M_1$ is at least one of the elements selected from the group of Aluminum (Al), Niobium (Nb), Chromium (Cr), and others, while M is, at least, one of the elements selected from the group of Titanium (Ti), Hafnium (Hf), Zirconium (Zr), Vanadium (V), Tantalum (T), etc. The relative proportions of the above components within the magnetic material are as follows: at. % 8-30% $R=R_1+R_2$; 2-28% B, not to exceed 50% Co, and the remainder is iron (Fe) with admixtures of $M=M_1+M_2$, not to exceed 12.5 %.

The presence of Cobalt (Co)in the magnetic material raises its Curie temperature (Tc) and brings it to 750° C. This allows the known material to be utilized without a significant decrease of its magnetic qualities within the temperatures from 120°-160° C. However a high Cobalt (Co) content in the material produces a soft magnetic phase enriched with Cobalt, which causes an abrupt decrease of the coercive force iHc. In order to compensate for the decrease of the coercive force iHc, the alloy is being formulated with intensified amount of rare earth elements and Boron (B), which, in turn, brings about the decrease of (BH)max. The latter is explained by relative decrease in the core phase volume $Nd_2Fe_{14}B$. The average size of the core phase granules within the known magnetic material ranges within 1-100 μm, which determines its low coercive force iHc. Additionally, the known material is characterized by its relatively low technology, caused mostly by the relatively high stability of ingot and the caking temperature, which, in turn, causes the high degree of energy expenditures in the event of ingot shredding and caking.

SUMMARY OF THE INVENTION

The basic goal of the present invention is to create magnetic material of a chemical composition and of an at. % of the component contents that would allow it to possess a high coercive force iHc value. This is achieved by the optimization of the phase structures, which isolate the granules of the main phase $Nd_2Fe_{14}B$, by the size of the main phase granules, and by relatively low specific energy expenditures.

This goal has been achieved in the following fashion: the magnetic material contains Fe-B-Co-R, within which R constitutes the sum total of $R_1$ and $R_2$, while $R_1$ is, at least, one of the rare earth elements selected from the group of Neodymium (Nd) and Praseodymium (Pr) while $R_2$ is at least one of the heavy rare earth elements selected from the group of Dysprosium (Dy) and Terbium (Tb), and the admixture of M, which constitutes the sum total of $M_1$ and $M_2$, while $M_1$ is at least one of the elements selected from the group of Aluminum (Al), Niobium (Nb), Chromium (Cr), while $M_2$ is at least, one of the elements selected from the group of Titanium (Ti), Hafnium (Hf), Zirconium (Zr), Vanadium (V), Tantalum (Ta), and also, according to the invention, contains Uranium (U) with the following relative proportions of its components, at. %:

at least one of the rare earth elements selected from the group of Neodymium and Praseodymium 12.0-17.0;

at least one of the rare earth elements selected from the group of Dysprosium and Terbium 0.1-5.0 at least one of the elements selected from the group of Aluminum, Niobium, and Chrome 0.5-4.0;

at least one of the elements selected from the group of Titanium, Hafnium, Zirconium, Vanadium, and Tantalum 0.1-1.5;

Cobalt 2.0-6.0

Boron 6.5-8.5

Uranium 0.05-1.5

Iron remainder

If it is required that the Uranium not emit radiation exceeding the natural background radiation of cosmic rays and the radiation of isotopes naturally present in the environment, it is imperative that the Uranium (U) would have the following isotopic composition at. %

| | |
|---|---|
| Uranium 238 | 99.7-99.9999 |
| Uranium 235 | 0.0001-0.3 |

This kind of magnetic material, according to the invention, will be endowed with high magnetic qualities, more specifically, will have a heightened value of coercive force iHc of about 25 kOe with (BH)max=29-35 MGOe and specific energy expenditures of 0.71-0.9.

The introduction of Uranium (U) into the magnetic material enhances the isolating qualities of the intergranular phases of the type U-Fe-Co-R and increases the anisotrophic field of the core phase $(U+R)_2Fe_{14}B$. According to the invention, the x-ray diffraction analysis of the magnetic material has shown that the Uranium ions come to partially replace the ions of Neodymium within the lattice of the core phase and $Nd_2Fe_{14}B$. However, it should be noted, that for the main part, those ions are located in the intergranular Neodymium enriched phases, which isolate the granules of the core phase.

The magnetic qualities of the Uranium compounds are determined by the degree of localization of the Uranium ion electron 5f. In the combination of Uranium (U) with Iron (Fe) the Uranium valence electrons move into the "d" area of iron (Fe) until its full saturation thus decreasing the magnetic aspects of the iron (Fe) atom. If the Uranium (U) contents within the magnetic material is not in excess of 0.05 at. %, it will have no effect for all intents and purposes on the magnetic aspect of the iron (Fe) atoms or on the $H_A$ field of the core phase anisotrophy. When the Uranium (U) contents is within the indicated range of 0.05-1.5 at. % the Uranium ions, replacing the Neodymium ions within the lattice of the core phase, increase the $H_A$ field anisotrophy and, consequently, the coercive force iHc due to the partial localization of valence electrons (5f electrons). Furthermore Uranium (U) reaching the lattice of the intergranular phases of U-Fe-Co-R, lowers their Curie temperature (Tc) to values substantially below room temperature. Therefore, the intergranular phases of U-Fe-Co-B become paramagnetic when magnets made of this material composition are operated, thus well securing the magnetic isolation of the core phase granules and enhancing, in turn, the coercive force. In addition, enriching the intergranular phases with Uranium causes the decrease in the wetability of the core phase granules and consequently the increase of the alloy embrittlement.

The magnetic material, according to the invention, is characterized by the diminished specific energy expenditure at the time of the powder preparation as well as at the time of its caking due to the enhanced embrittlement of the fused material and its enhanced cakability at lower temperatures of 1000°-1100° C.

If the Uranium (U) contents within the magnetic material exceeds 1.5 at. % its concentration in the core phase $Nd_2Fe_{14}B$ will reach the level at which one can observe an abrupt decrease of the magnetic aspects of iron (Fe) atoms as well as of the $H_A$ field anisotrophy and, consequently, a decrease in the coercive force iHc due to the delocalization of valence electrons (5f electrons). The alloy fusion with Uranium exerts a positive effect on the magnetic material, and more specifically, enhances its coercive force iHc, which is related also to the decrease in the size of the core phase $Nd_2Fe_{14}B$ granules to the range of 4–6 μm. It should be noted that the higher the concentration of Uranium in the material, then the lower the average size of the granules.

The natural Uranium is characterized by α-activity which is determined mainly by the Uranium 235 isotope. At the Uranium isotopic composition as indicated above and within the range of its values, the magnitude of the dose of α-radiation exposure does not exceed the natural background radiation of the cosmic rays and the radiation of the isotopes naturally distributed in the environment.

Introduction of Scandium into the magnetic material increases its coercive force iHc. This is connected to the changes within the fine structure of the intergranular phases, isolating the core phase $Nd_2Fe_{14}B$ granules, since it is known that Scandium forms the ideal hard solutions when combined with the rare earth elements. Additionally, the Scandium ions assist in the localization of Uranium 5f electrons while partially replacing Neodymium ions within $(U+R)_2Fe_{14}B$ phase, and, consequently, enhance and heighten the $H_A$ field anisotrophy and the coercive force iHc.

Introduction of Gallium (Ga) into the magnetic material increases its coercive force iHc, for the following reasons. Gallium will replace Iron within the core phase $Nd_2Fe_{14}B$, assuming positions $8j_1$ and 4c in the node, positions which are connected with the antiferromagnetic interaction which causes, in tun, some increase in the Curie temperature. However, the main positive consequence and effect from the presence of Gallium stems from fact that by improving the core phase $Nd_2Fe_{14}B$ granule wetability by a liquid phase it facilitates and enhances their magnetic isolation, thus, consequently, increasing the coercive force iHc. In the event that the amount of Gallium (Ga) exceeds 4 at. % the magnetic material will exhibit $H_A$ field anisotrophy decrease within the $Nd_2Fe_{14}B$ core phase, and, consequently, the decrease in the coercive force iHc.

BRIEF DESCRIPTION OF DRAWINGS

Other advantages and goals of this invention will become clearer and more readily understandable on the basis of the following specific examples of its implementation and its charts which show.

DESCRIPTION OF THE PREFERRED EMBODIMENTS

Figure 1:
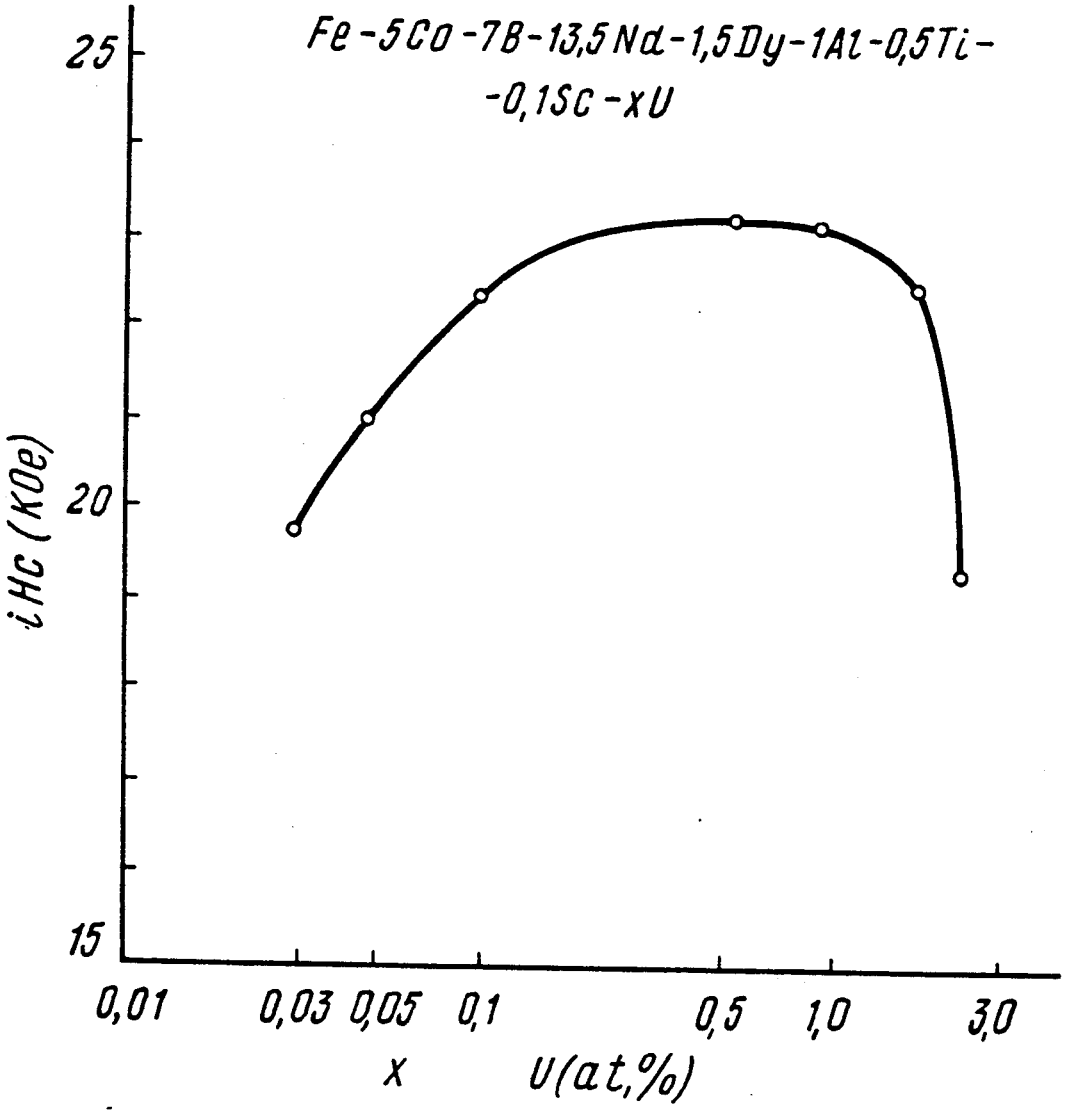
FIG. 1 table demonstrating the relationship between coercive force iHc and Uranium (U) content.

The magnetic material as represented in this invention contains Fe-B-Co-U-R-M. R constitutes the sum total of $R_1$ and $R_2$, while $R_1$ is, at least, one of the rare earth elements selected from the group of Neodymium (Nd) and Praseodymium (Pr) while $R_2$ is at least one of the rare earth elements selected from the group of Dysprosium (Dy) and Terbium (Tb). The admixture of M, constitutes the sum total of $M_1$ and $M_2$, while $M_1$ is at least one of the elements selected from the group of Aluminum (Al), Niobium (Nb), Chromium (Cr), and Gallium (Ga) while $M_2$ is, at least, one of the elements selected from the group of Titanium (Ti), Hafnium (Hf), Zirconium (Zr), Vanadium (V), Tantalum (Ta), and Scandium (Sc). The magnetic material indicated above contains the above components in the following relative proportions of at. %:

| | |
|---|---|
| Neodymium and/or Praseodymium | 12.0–17.0 |
| Dysprosium and/or Terbium | 0.1–5.0 |
| Aluminum and/or Niobium, and/or Gallium, and/or Chrome | 0.5–4.0 |
| Titanium and/or Hafnium, and/or Zirconium, and/or Vanadium, and/or Tantalum, and/or Scandium | 0.1–1.5 |
| Cobalt | 2.0–6.0 |
| Boron | 6.5–8.5 |
| Uranium | 0.05–1.5 |
| Iron | remainder |

Uranium introduced into the magnetic matter as described in this invention has the following isotopic composition in at. %:

| | |
|---|---|
| Uranium 238 | 99.7–99.9999 |
| Uranium 235 | 0.0001–0.3 |

Its dosage magnitude of α-radiation exposure does not exceed the natural background radiation of the cosmic rays and the radiation of the isotopes naturally distributed in the environment. The cumulative content of the elements in the magnetic material is as follows: Neodymium and/or Praseodymium, Dysprosium and/or Terbium and Uranium are in tile range of 15–17.6 at. % At the same time the cumulative content of the elements listed below in the magnetic material is as follows:

at least one element selected from tile group of Aluminum (Al), Niobium (Nb), Chrome (Cr), Gallium (Ga), and at least one element selected from the group of Titanium (Ti), Hafnium (Hf), Zirconium (Zr), Vanadium (V), Tantalum (Ta), and Scandium (Sc) are within the range of 0.6–4.5 at. %

The magnetic material according to this invention is obtained in the following manner.

As a first step, fusion is obtained in a vacuum induction oven with an Argon atmosphere maintained at a pressure of 300 mm Hg. The composition of the material produced corresponds to the magnetic materials which are presented in Table No. 1. Boron is introduced into the fusion as an alloy Fe-10 mass % B (at. %). The obtained alloy is transferred into a water-cooled, copper ingot mold and an ingot is thus made. This ingot is initially grossly fragmented into particles smaller than 500 μm and then pulverized in a vibrational ball grinder into particles that are 1–5 μm in size. The powder thus obtained is then placed into a magnetic field with a force of 10 kOe in order to create magnetic texturing while being molded under a pressure of 0.1–5 t/cm$^2$. The pressed material obtained is then caked at a temperature 1000°–1200° C. with subsequent heat treatment of the cake at temperatures between 400°–1000° C.

Examples of the magnetic material obtained by the procedure outlined in this invention are presented below.

EXAMPLE 1

Magnetic material Fe-5Co-7-B-13, 5Nd-1, 5Dy-1Al-O, 5Ti-O, 1So-xU is obtained as follows.

A fusion is obtained in a vacuum induction oven with an Argon atmosphere maintained at a pressure of 300 mm Hg. The composition of the material produced corresponds to the magnetic material presented in Table No. 1 (3, 27, 28, 29, 31, 32, 39). An ingot is obtained from the fusion as specified above which is subsequently fragmented and pulverized into particles of 3–4 μm in size. The pulverized particles are placed into a magnetic field with a force not less than 10 kOe while being molded under a pressure of 0.4 t/cm$^2$. The material thus obtained is caked at a temperature of 1030°–1130° C. over a period of 2 hours with subsequent heat treatment of the cake at temperatures between 550°–910° C.

Figure 2:
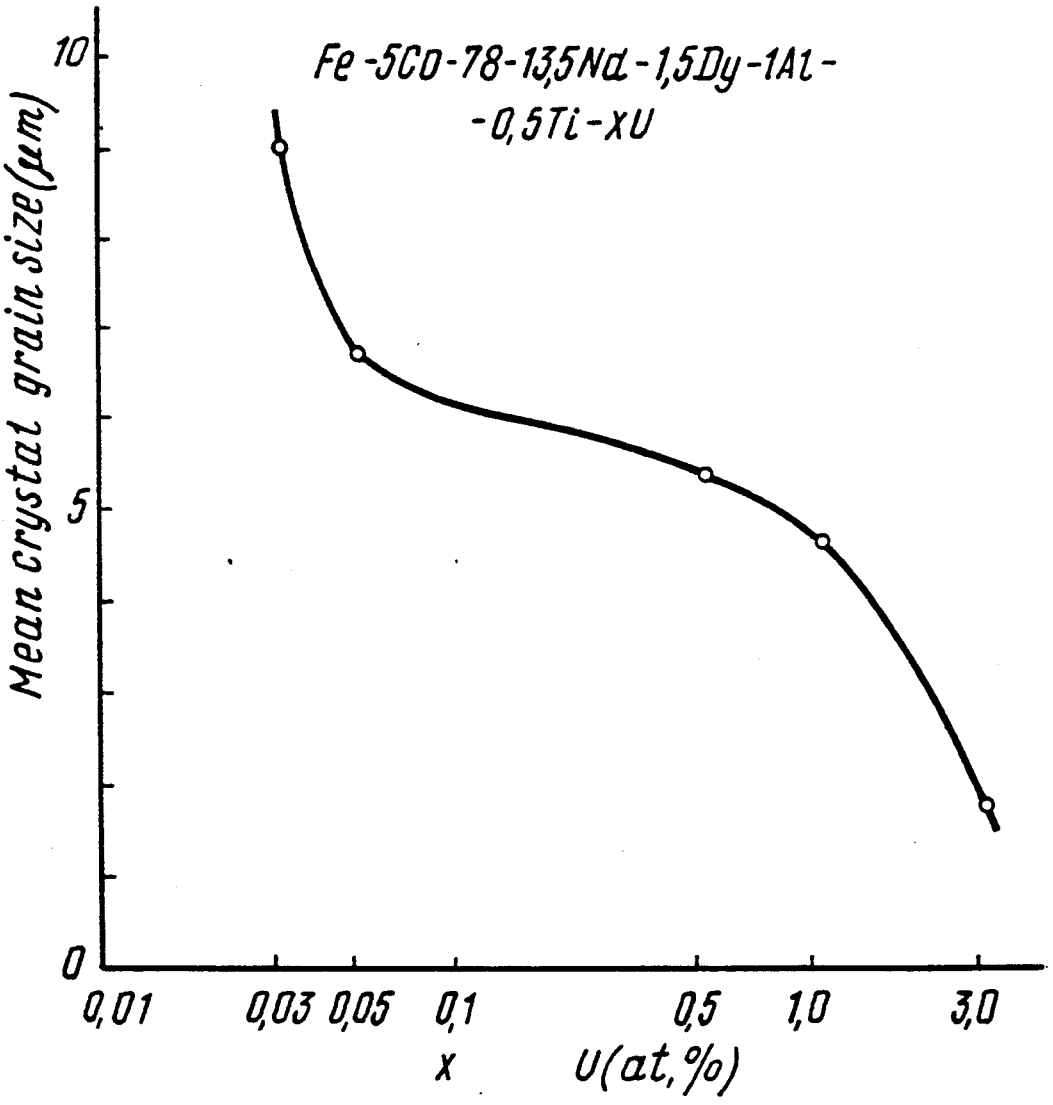
FIG. 2 table demonstrating the relationship between coercive force iHc and the average granule size.

The magnetic traits of this material as well as the specific amounts of energy expenditure are listed in Table 1. The effect of Uranium on the coercive force intensity iHc can be seen in the Chart which appears in FIG. 1. Analysis of the curve displayed indicates that an abrupt increase of the coercive force iHc up to 23 kOe takes place when the content of Uranium in the magnetic material is within the range of x=0.05–0.2 at. % This is caused by two factors. First, by the decrease in the average size of the core phase $Nd_2Fe_{14}B$ granules due to the increase in the Uranium content within the magnetic material (see FIG. 2) and, secondly, due to the partial replacement of Neodymium ions by those of Uranium while maintaining the localization of 5f Uranium ion electrons and enhancing the anisotrophic H field. As FIG. 2 indicates; the granule size is monotonously decreasing, proportionally to the increase of the Uranium content, while in the range of x=0.2–1.5 at. % (FIG. 1) the coercive force value iHc is virtually lost; it stands at 23.1 kOe and is independent of the Uranium content. This virtual stability of the iHc value is determined by two contradictory processes. On the one hand, there is an increase in the Uranium content within the core phase, which, in turn, brings about the partial delocalization of its 5f electrons and consequently the decline of the anisotrophic field of the magnetic core phase $Nd_2Fe_{14}B$. On the other hand, the decrease in granule size causes an increase in the iHc; however, this is mainly obtained due to the decrease in the number of centers in which reverse polarity is generated. With the increase of concentration x>1.5 at/% U, the delocalization of 5f Uranium electrons within the core phase causes an abrupt decrease in the anisotrophic field and consequently the decrease in the coercive force iHc.

EXAMPLE 2

The magnetic material: Fe-5Co-7B-13, 5Nd-O,5U-1, 5Dy-1Al-O,5Ti-xSc is obtained in the following fashion.

A fusion is obtained in a vacuum induction oven with an Argon atmosphere maintained at a pressure of 300 mm Hg. The composition of the material produced corresponds to the magnetic material presented in Table No. 1 (3, 16, 63, 64, 65). An ingot is obtained from the fusion as specified above which is subsequently fragmented and pulverized into particles of 3 μm in size. The pulverized particles are placed into a magnetic field with a force not less than 10 kOe while being molded under a pressure of 0.8 t/cm$^2$. The material thus obtained is caked at a temperature of 1070° C. over a period of 2 hours with subsequent heat treatment of the cake at temperatures between 560°–910° C.

The magnetic traits of this material as well as the specific amounts of energy expenditure are listed in Table 1.

Figure 3:
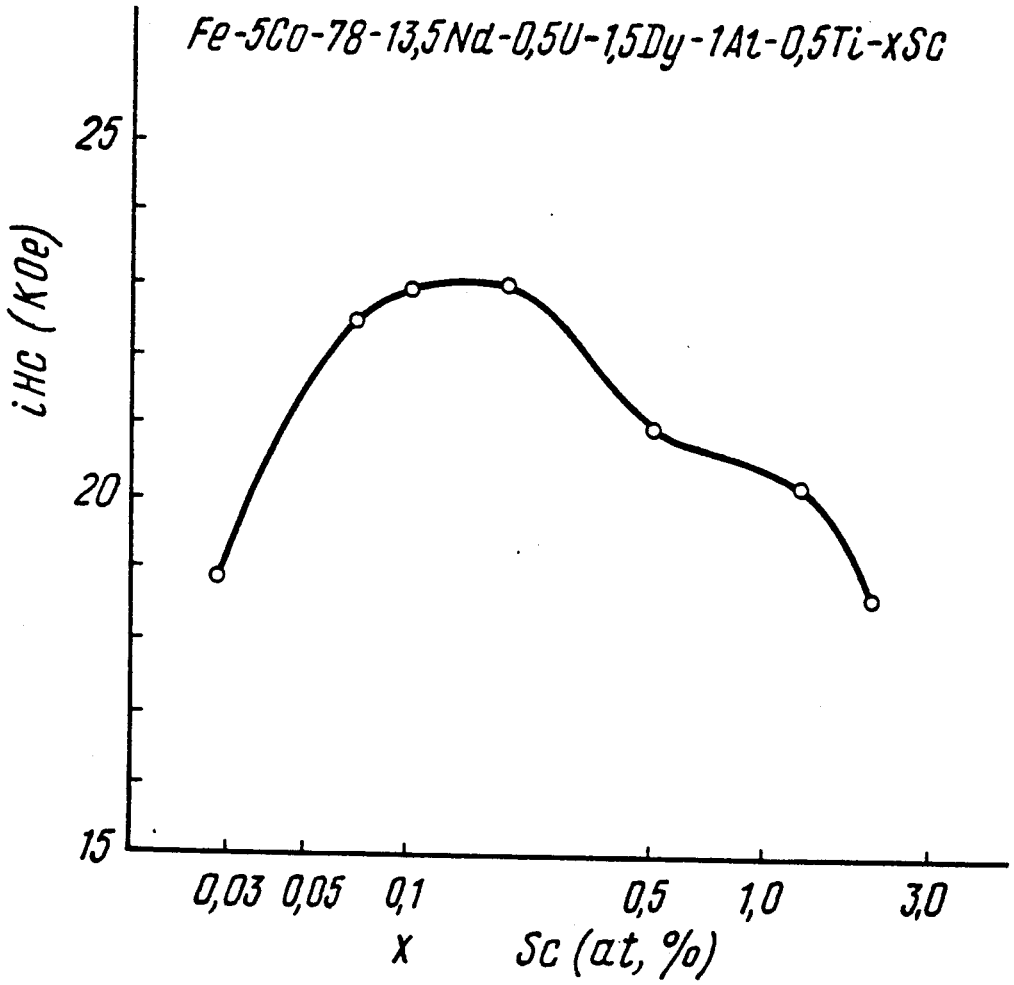
FIG. 3 table demonstrating the relationship between coercive force iHc and Scandium (Sc) contents.

The effect of Scandium content on the coercive force intensity iHc can be seen in tire Chart which appears in FIG. 3. Analysis of the curve displayed indicates that an abrupt increase of the coercive force iHc up to 23 kOe takes place when the content of Scandium in the magnetic material is within the range of x=0.03–0.1 at. %. This is due to the fact that the presence of Scandium ions within the core phase $Nd_2Fe_{14}B$ causes delocalization of 5f Uranium electrons. Additionally, since Scandium forms hard solutions with all of the rare earth metals it brings about a change in structure of all of the intergranular phases thus decreasing the number of centers in which the reverse magnetic force may be generated. The increase of Scandium content level to greater than 1.5 at. % causes the decrease of iHc due to the decrease in the anisotrophic field of the core phase $Nd_2Fe_{14}B$. Scandium exerts a positive influence on the coercive force only when in combination with such elements as U and Dy.

EXAMPLE 3

The magnetic material: Fe-5Co-7B-13, 5Nd-O,5U-1, 5Dy-1Al-O,1Sc-xGa is obtained in the following fashion.

A fusion is obtained in a vacuum induction oven with an Argon atmosphere maintained at a pressure of 300 mm Hg. The composition of the material produced corresponds to the magnetic material presented in Table No. 1 (49, 66–71). An ingot is obtained from the fusion as specified above which is subsequently fragmented and pulverized into particles of 3 μm in size. The pulverized particles are placed into a magnetic field with a force not less than 10 kOe while being molded under a pressure of 0.8 t/cm$^2$. The material thus obtained is caked at a temperature of 1000°–1100° C. over a period of 2 hours with subsequent heat treatment of the cake at temperatures between 490°–920° C.

The magnetic traits of this material as well as the specific amounts of energy expenditure are listed in Table 1.

Figure 4:
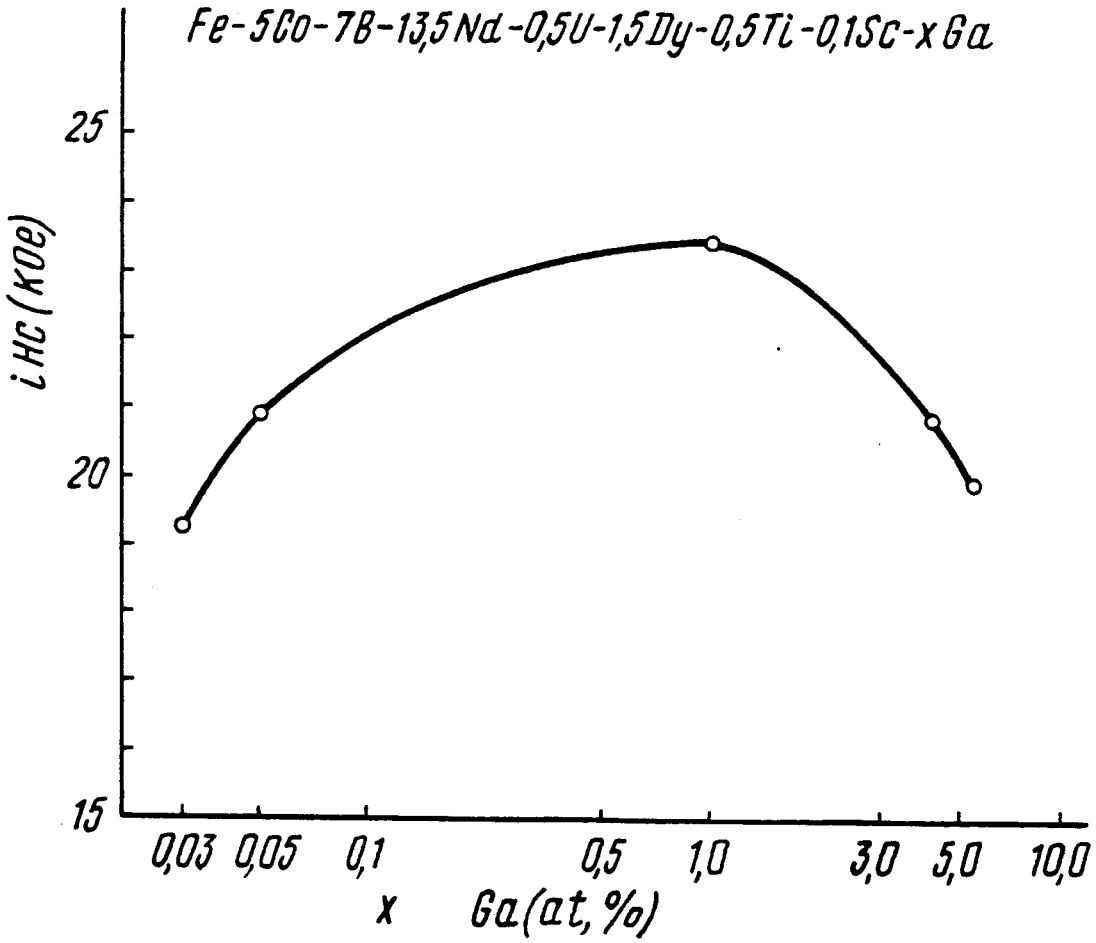
FIG. 4 table demonstrating the relationship between coercive force iHc and Gallium (Ga) content.

The effect of Gallium content on the coercive force intensity iHc appears in FIG. 4. The nature of iHc curve behavior with a change in x is similar to the nature of changes in the coercive force behavior that occur with a change in the content of Uranium or Scandium.

The abrupt increase of the coercive force iHc up to 23.2 kOe takes place when the content of Gallium is within the range of x=0.03–1.0 at. % and is related to the increase in the anisotrophic field of the core phase with a partial replacement of Iron by Gallium. Additionally, Gallium enable a better magnetic isolation of the core phase granules at the time of caking since it enhances the core phase $Nd_2Fe_{14}B$ granule wetability with a liquid phase. The abrupt decrease of the coercive force iHc at x>4 at. % Ga is related to a number of factors. First of all, the Curie temperature (Tc) of the core phase (and therefore also of the anisotrophic constant) begins to decrease rapidly due to the fact that Iron is being replaced by Gallium (Ga). Secondly, the mutual interaction between the Iron and the rare earth element grids decreased due to the fact that Gallium is not magnetized.

Industrial Applications

The most successful application of this invention is in the realm of electronics and electrical technology and engineering.

The magnetic material presented in this invention, at the specific expenditures in the range of 0.71–0.9 has residual induction Br=10.5–25.5 kG, coercive force iHc=14–25.1 kOe, energy generation (BH)max=29-.5–36.0 MGOe and maybe operated at temperatures up to 180°–250° C.

TABLE 1-1

| No. | Compositions (at. %) | magnetic properties iHc (kOe) | Br (kG) | (BH) max (MG Oe) | Specific energy expenditures |
|---|---|---|---|---|---|
| 1 | Fe-5Co-7B-11Nd-0.5U-6Dy-1Al-0.5Ti-0.1Sc | 20.0 | 10.5 | 26.7 | 0.80 |
| 2 | Fe-5Co-7B-12Nd-0.5U-2.5Dy-1Al-0.5Ti-0.1Sc | 23.0 | 11.0 | 29.4 | 0.82 |
| 3 | Fe-5Co-7B-13.5Nd-0.5U-1.5Dy-1Al-0.5Ti-0.1Sc | 23.0 | 11.4 | 31.5 | 0.82 |
| 4 | Fe-5Co-7B-15Nd-0.5U-0.8Dy-1Al-0.5Ti-0.1Sc | 20.8 | 11.1 | 29.9 | 0.83 |
| 5 | Fe-5Co-7B-17Nd-0.5U-0.1Dy-1Al-0.5Ti-0.1Sc | 20.5 | 11.0 | 29.4 | 0.81 |
| 6 | Fe-5Co-7B-18Nd-0.1U-0.1Dy-1Al-0.5Ti-0.1Sc | 20.4 | 10.8 | 28.3 | 0.95 |
| 7 | Fe-5Co-7B-13.5Pr-0.5U-1.5Dy-1Al-0.5Ti-0.1Sc | 23.8 | 11.2 | 30.4 | 0.82 |
| 8 | Fe-5Co-7B-14Nd-0.5U-1.5Dy-1Al-0.5Ti-0.1Sc | 23.5 | 11.3 | 31.0 | 0.81 |
| 9 | Fe-5Co-7B-11Pr-0.5U-5Dy-1Al-0.5Ti-0.1Sc | 20.5 | 10.5 | 26.7 | 0.81 |
| 10 | Fe-5Co-7B-12Pr-0.5U-2.6Dy-1Al-0.5Ti-0.1Sc | 23.0 | 11.0 | 29.4 | 0.81 |
| 11 | Fe-5Co-7B-13.5Pr-0.5U-1.6Dy-1Al-0.5Ti-0.1Sc | 23.1 | 11.5 | 31.6 | 0.82 |
| 12 | Fe-5Co-7B-17Pr-0.4U-0.1Dy-1Al-0.5Ti-0.1Sc | 20.5 | 11.0 | 29.4 | 0.81 |
| 13 | Fe-5Co-7B-18Pr-0.1U-0.1Dy-1Al-0.5Ti-0.1Sc | 20.1 | 10.8 | 28.3 | 0.95 |
| 14 | Fe-5Co-7B-17Nd-0.5U-0.5Dy-1Al-0.5Ti-0.1Sc | 19.8 | 11.1 | 29.9 | 0.75 |
| 15 | Fe-5Co-7B-15.5Nd-0.5U-0.1Dy-1.5Al-0.5Ti-0.2Sc | 20.7 | 11.6 | 32.6 | 0.84 |

TABLE 1-2

| N0. | Compositions (at. %) | magnetic properties iHc (kOe) | Br (kG) | (BH) max (MG Oe) | Specific energy expenditures |
|---|---|---|---|---|---|
| 16 | Fe-5Co-7B-13.5Nd-0.5U-1.5Dy-1Al-0.5Ti-0.2Sc | 23.0 | 11.4 | 31.5 | 0.83 |
| 17 | Fe-5Co-7B-12.5Nd-0.5U-2.5Dy-0.5Al-0.5Ti-0.2Sc | 23.0 | 11.0 | 29.5 | 0.84 |
| 18 | Fe-5Co-7B-12Nd-0.1U-5Dy-0.5Al-0.5Ti-0.07Sc | 21.2 | 11.0 | 29.5 | 0.89 |
| 19 | Fe-5Co-7B-11Nd-0.1U-6DY-0.5Al-0.1Ti-0.07Sc | 22.3 | 10.7 | 27.8 | 0.90 |
| 20 | Fe-5Co-7B-12Nd-0.5U-2.5Tb-0.5Al-0.5Ti-0.3Sc | 23.0 | 11.0 | 29.4 | 0.82 |
| 21 | Fe-5Co-7B-12Nd-0.5U-1.5Dy-0.5Al-0.5Ti-0.2Sc | 22.8 | 11.0 | 29.6 | 0.81 |
| 22 | Fe-5Co-7B-17Nd-0.5U-0.05Tb-0.5Al-0.5Ti-0.1Sc | 19.9 | 11.1 | 29.8 | 0.75 |
| 23 | Fe-5Co-7B-15.5Nd-0.5U-0.1Tb-0.5Al-0.5Ti-0.2Sc | 20.8 | 11.6 | 32.7 | 0.84 |
| 24 | Fe-5Co-7B-13.5Nd-0.5U-1.5Tb-0.5Al-0.5Ti-0.2Sc | 23.0 | 11.4 | 31.5 | 0.87 |
| 25 | Fe-5Co-7B-12Nd-0.2U-5Tb-0.5Al-0.5Ti-0.07Sc | 21.2 | 11.0 | 29.5 | 0.89 |
| 26 | Fe-5Co-7B-11Nd-0.1U-6Tb-0.5Al-0.1Ti-0.7Sc | 22.3 | 10.7 | 27.6 | 0.90 |
| 27 | Fe-5Co-7B-13.5Nd-0.03U-1.5Dy-1Al-0.5Ti-0.2Sc | 19.8 | 11.5 | 32.1 | 0.99 |
| 28 | Fe-5Co-7B-13.5Nd-0.05U-1.5Dy-1Al-0.5Ti-0.4Sc | 21.0 | 11.4 | 31.5 | 0.90 |
| 29 | Fe-5Co-7B-13.5Nd-0.7U-1.5Dy-1Al-0.5Ti-0.1Sc | 23.1 | 11.3 | 31.0 | 0.80 |
| 30 | Fe-5Co-6.6B-14.5Nd-0.05U-0.1Dy-0.5Al-0.1Ti-0.05Sc-0.05Ga | 14.0 | 12.5 | 36.0 | 0.90 |

TABLE 1-3

| N0. | Compositions (at. %) | magnetic properties iHc (kOe) | Br (kG) | (BH) max (MG Oe) | Specific energy expenditures |
|---|---|---|---|---|---|
| 31 | Fe-5Co-7B-13.5Nd-1.5U-1.5Dy-1Al-0.5Ti-0.07Sc | 22.5 | 11.0 | 29.6 | 0.71 |
| 32 | Fe-5Co-7B-13.5Nd-2U-1.5Dy-1Al-0.5Ti-0.07Sc | 19.5 | 10.5 | 26.7 | 0.68 |
| 33 | Fe-1Co-7B-13.5Nd-0.5U-1.5Dy-1Al-0.5Ti-0.2Sc | 23.2 | 11.4 | 29.2 | 0.83 |
| 34 | Fe-2Co-7B-13.5Nd-0.5U-1.5Dy-1Al-0.5Ti-0.1Sc | 23.2 | 11.4 | 31.5 | 0.82 |
| 35 | Fe-6Co-7B-13.5Nd-0.5U-1.5Dy-1Al-0.5Ti-0.1Sc | 21.5 | 11.4 | 31.5 | 0.84 |
| 36 | Fe-8Co-7B-13.5Nd-0.5U-1.5Dy-1Al-0.5Ti-0.1Sc | 19.0 | 11.0 | 29.3 | 0.81 |
| 37 | Fe-5Co-6B-13.5Nd-0.5U-1.5Dy-1Al-0.5Ti-0.1Sc | 20.0 | 10.8 | 28.3 | 0.82 |
| 38 | Fe-5Co-6.5B-13.5Nd-0.5U-1.5Dy-1Al-0.5Ti-0.1Sc | 21.5 | 11.2 | 30.4 | 0.85 |
| 39 | Fe-5Co-7B-13.5Nd-0.5U-1.5Dy-1Al-0.5Ti-0.1Sc | 23.0 | 11.4 | 31.5 | 0.84 |
| 40 | Fe-5Co-8.5B-13.5Nd-0.5U-1.5Dy-1Al-0.5Ti-0.1Sc | 24.5 | 11.1 | 29.9 | 0.82 |
| 41 | Fe-5Co-10B-13.5Nd-0.5U-1.5Dy-1Al-0.5Ti-0.1Sc | 25.1 | 10.5 | 26.7 | 0.82 |
| 42 | Fe-5Co-7B-12Nd-0.5U-5Dy-0.1Al-0.5Ti-0.1Sc | 19.8 | 11.3 | 31.0 | 0.84 |
| 43 | Fe-5Co-7B-12Nd-0.5U-5Dy-0.5Al-0.1Ti-0.06Sc | 21.2 | 11.0 | 29.6 | 0.84 |

TABLE 1-4

| N0. | Compositions (at. %) | magnetic properties iHc (kOe) | Br (kG) | (BH) max (MG Oe) | Specific energy expenditures |
|---|---|---|---|---|---|
| 44 | Fe-5Co-7B-13.5Nd-0.5U-1.5Dy-3Al-0.5Ti-0.1Sc | 22.5 | 11.2 | 30.4 | 0.83 |
| 45 | Fe-5Co-7B-16Nd-0.5U-1.5Dy-4Al-0.4Ti-0.1Sc | 21.8 | 11.0 | 29.4 | 0.84 |
| 46 | Fe-5Co-7B-16Nd-0.5U-0.1Dy-5Al-0.1Ti-0.1Sc | 22.1 | 10.7 | 27.8 | 0.83 |
| 47 | Fe-5Co-7B-13.5Nd-0.5U-1.5Dy-1Nb-0.5Ti-0.1Sc | 22.5 | 11.4 | 31.5 | 0.83 |
| 48 | Fe-5Co-7B-13.5Nd-0.5U-1.5Dy-1Cr-0.5Ti-0.1Sc | 23.0 | 11.2 | 30.4 | 0.83 |
| 49 | Fe-5Co-7B-13.5Nd-0.5U-1.5Dy-0.5Ti-0.1Sc-1Ga | 23.2 | 11.4 | 31.5 | 0.84 |
| 50 | Fe-5Co-7B-13.5Nd-0.5U-1.5Dy-1Al-0.5Nb-0.5Cr-0.5Ti-0.1Sc-1Ga | 22.5 | 11.1 | 29.9 | 0.84 |
| 51 | Fe-5Co-7B-13.5Nd-0.5U-1.5Dy-1Al-0.05Ti-0.1Sc | 19.9 | 11.5 | 32.1 | 0.82 |
| 52 | Fe-5Co-7B-13.5Nd-0.5Nd-0.5U-1.5Dy-1Al-0.1Ti-0.1Sc | 21.5 | 11.4 | 31.5 | 0.82 |
| 53 | Fe-5Co-7B-13.5Nd-0.5U-1.5Dy-1Al-1.5Ti-0.1Sc | 23.2 | 11.0 | 29.4 | 0.83 |
| 54 | Fe-5Co-7B-13.5Nd-0.5U-1.5Dy-1Al-2Ti-0.1Sc | 23.5 | 10.7 | 27.8 | 0.84 |
| 55 | Fe-5Co-7B-13.5Nd-0.5U-1.5Dy-1Al-0.5Hf-0.2Sc | 22.3 | 11.2 | 30.4 | 0.82 |
| 56 | Fe-5Co-7B-13.5Nd-0.5U-1.5Dy-1Al-0.5Zr-0.2Sc | 22.5 | 11.2 | 30.4 | 0.82 |
| 57 | Fe-5Co-7B-13.5Nd-0.5U-1.5Dy-1Al-0.5Hf-0.5Zr-0.5Sc | 22.8 | 11.2 | 30.4 | 0.82 |

TABLE 1-5

| No. | Compositions (at. %) | magnetic properties iHc (kOe) | Br (kG) | (BH) max (MG Oe) | Specific energy expenditures |
|---|---|---|---|---|---|
| 58 | Fe-5Co-7B-13.5Nd-0.5U-1.5Dy-1Al-0.5V-1.2Sc | 22.9 | 11.2 | 30.5 | 0.84 |
| 59 | Fe-5Co-7B-13.5Nd-0.5U-1.5Dy-1Al-0.5Ta-0.1Sc | 23.0 | 11.1 | 30.4 | 0.82 |
| 60 | Fe-5Co-7B-13.5Nd-0.5U-1.5Dy-1Al-0.1Ti-0.1Hf-0.1Zr-0.1V-0.1Ta-0.1Sc | 23.0 | 11.2 | 30.3 | 0.82 |
| 61 | Fe-5C0-7B-13.5Nd-0.5U-1.5Dy-1Al-0.1Ti-0.1Hf-0.1V-0.03Sc | 18.8 | 11.2 | 30.1 | 0.88 |
| 62 | Fe-5Co-7B-13.6Nd-0.5U-1.5Dy-1Al-0.15Ti-0.1V-0.05Sc | 20.9 | 11.2 | 30.1 | 0.86 |
| 63 | Fe-5Co-7B-13.5Nd-0.5U-1.5Dy-1Al-0.15Ti-0.5Sc | 21.0 | 11.2 | 30.4 | 0.82 |
| 64 | Fe-5Co-7B-13.6Nd-0.5U-1.5Dy-1Al-0.2Ti-1.5Sc | 20.4 | 11.1 | 30.1 | 0.82 |
| 65 | Fe-5Co-7B-13.5Nd-0.5U-1.5Dy-1Al-1.15Ti-2Sc | 19.0 | 11.0 | 29.5 | 0.82 |
| 66 | Fe-5Co-7B-13.5Nd-0.5U-1.6Dy-1Al-0.05Sc-0.03Ga | 19.3 | 11.2 | 29.0 | 0.83 |
| 67 | Fe-5Co-7B-13.5Nd-0.5U-1.6Dy-1Al-0.05Sc-0.05Ga | 20.8 | 11.1 | 29.5 | 0.83 |
| 68 | Fe-5Co-7B-13.5Nd-0.5U-1.6Dy-1Al-0.05Sc-0.5Ga | 21.0 | 11.0 | 29.7 | 0.82 |
| 69 | Fe-5Co-7B-13.5Nd-0.5U-1.6Dy-1Al-0.05Sc-1Ga | 21.4 | 11.0 | 29.8 | 0.82 |
| 70 | Fe-5Co-7B-13.5Nd-0.5U-1.6Dy-0.5Al-0.5V-0.05Sc-4Ga | 20.9 | 11.0 | 29.5 | 0.82 |
| 71 | Fe-5Co-7B-13.5Nd-0.5U-1.6Dy-0.5Al-0.05Sc-5.5Ga | 19.7 | 11.1 | 27.0 | 0.82 |

We claim:

1. Magnetic material containing Fe-B-Co-R wherein R constitutes $R_1$ and $R_2$, with $R_1$ comprising at least one of the rare earth elements selected from the group consisting of Neodymium (Nd) and Praseodymium (Pr), with $R_2$ comprising at least one of the rare earth elements selected from the group consisting of Dysprosium (Dy) and Terbium (Tb), and an admixture of M, which constitutes $M_1$ and $M_2$, $M_1$ comprising at least one of the elements selected from the group consisting of Aluminum (Al), Niobium (Nb), and Chromium (Cr), and $M_2$ comprising at least one of the elements selected from the group consisting of Titanium (Ti), Hafnium (Hf), Zirconium (Zr), Vanadium (V), and Tantalum (Ta), said magnetic material also containing Uranium (U) and having the following relative proportion of components, in atomic %:

at least one of the rare earth elements selected from the group consisting of Neodymium and Praseodymium 12.0–17.0;

at least one of the rare earth elements selected from the group consisting of Dysprosium and Terbium 0.1–5.0;

at least one of the elements selected from the group consisting of Aluminum, Niobium, and Chromium 0.5–4.0;

at least one of the elements selected from the group consisting of Titanium, Hafnium, Zirconium, Vanadium, and Tantalum 0.1–1.5;

Cobalt 2.0–6.0

Boron 6.5–8.5

Uranium 0.05–1.5

Iron remainder.

2. The magnetic material, as claimed in claim 1 having the following isotopic composition in % Uranium:

Uranium 238 99.7–99.9999

Uranium 235 0.0001–0.3.

3. The magnetic material as claimed in claim 1, wherein the admixture $M_1$ also contains Gallium (Ga).

4. The magnetic material, as claimed in claim 1, wherein the admixture $M_2$ also contains Scandium (Sc).

5. The magnetic material as claimed in claim 3 wherein the admixture $M_2$ also contains Scandium (Sc).

6. The magnetic material as claimed in claim 2 wherein the admixture $M_1$ also contains Gallium (Ga).

7. The magnetic material as claimed in claim 6 wherein the admixture $M_2$ also contains Scandium (Sc).

* * * * *

UNITED STATES PATENT AND TRADEMARK OFFICE

CERTIFICATE OF CORRECTION

PATENT NO. : 5,334,265

DATED : August 2, 1994

INVENTOR(S) : Shalin et al

It is certified that error appears in the above-indentified patent and that said Letters Patent is hereby corrected as shown below:

Title Page:

IN THE TITLE - Item [54] and Column 1, line 2

Change "Magnetic Metal" to -- Magnetic Material--

Column 2, line 46 change "(Bit)max" to -- (BH)max--

Column 6, line 36 change "tile" to -- the--

Column 6, line 41 change "Chrome (Cr)" to --Chromium (Cr)--

Column 8, line 7 change "tire" to -- the--

Signed and Sealed this

Seventeenth Day of October, 1995

Bruce Lehman

*Attest:*

BRUCE LEHMAN

*Attesting Officer*

*Commissioner of Patents and Trademarks*